United States Patent [19]

Vernon

[11] 4,249,331

[45] Feb. 10, 1981

[54] DYNAMIC STAR BURST DISPLAY

[76] Inventor: John B. Vernon, 36 Meyer Pl., Riverside, Conn. 06878

[21] Appl. No.: 17,393

[22] Filed: Mar. 5, 1979

[51] Int. Cl.[3] ..... G09F 13/30

[52] U.S. Cl. ..... 40/432; 40/436; 40/444

[58] Field of Search ..... 40/431, 432, 436, 437, 40/442, 444, 414, 453, 454; 362/123, 232, 269, 311

[56] References Cited

U.S. PATENT DOCUMENTS

| | | | |
|---|---|---|---|
| Re. 25,895 | 11/1965 | Paige | 362/123 X |
| 739,845 | 9/1903 | Evans | 40/432 |
| 1,579,855 | 4/1926 | Beyer | 362/311 |
| 1,623,086 | 4/1927 | Bock | 362/123 |
| 1,855,297 | 4/1932 | Lawrence | 40/432 |
| 1,937,139 | 11/1933 | Barclay | 40/444 |
| 2,171,116 | 8/1939 | Muldoon | 362/123 |
| 2,186,327 | 1/1940 | Crosser | 362/123 |
| 2,297,171 | 9/1942 | Parman | 362/123 X |
| 2,608,779 | 9/1952 | Joy | 40/431 |
| 2,738,413 | 3/1956 | Knapp | 362/311 |
| 2,806,938 | 9/1957 | Henry | 362/123 X |
| 2,874,496 | 2/1959 | Rakes | 40/432 |
| 2,876,339 | 3/1959 | Thorne | 362/123 X |
| 3,247,609 | 4/1966 | Hayes et al. | 40/431 |
| 3,292,287 | 12/1966 | Marn | 40/431 |
| 3,531,636 | 9/1970 | Birch | 40/432 |
| 3,538,323 | 11/1970 | Ziegler | 362/806 |
| 3,544,783 | 12/1970 | Williams | 362/123 |
| 3,610,918 | 10/1971 | Barlow | 40/432 |
| 3,747,243 | 7/1973 | Schneider | 40/437 |
| 3,755,664 | 8/1973 | Reilback | 40/433 |
| 3,791,058 | 2/1974 | Mollica | 40/431 |
| 3,805,049 | 4/1974 | Frank et al. | 40/444 |
| 3,808,721 | 5/1974 | Gersch | 40/432 |
| 3,829,680 | 8/1974 | Jones | 362/339 X |
| 3,868,501 | 2/1975 | Barbour | 362/811 X |

*Primary Examiner*—John F. Pitrelli
*Assistant Examiner*—G. Lee Skillington
*Attorney, Agent, or Firm*—Parmelee, Johnson, Bollinger & Bramblett

[57] ABSTRACT

An attractive dynamic star burst display is provided in which a plurality of light sources preferably of different colors, are mounted behind a translucent enclosure, and relative movement is provided for effectively changing the distances between the light sources and the regions of the surface where their various rays are being viewed. The translucent enclosure includes a layer of intrinsically transparent material having a smooth inner surface facing the light sources and an embossed outer surface having a multifaceted pyramidal prism system for directing rays of light from the light sources in dynamically changing light patterns in accordance with the optical and geometric relationship involved, including the position of the viewer's eyes, the multi-facets on the embossed outer surface and the effective distance between the respective light sources and the respective regions on the embossed outer surface where the rays of light are being seen. A protective transparent or translucent layer is shown mounted over the embossed outer surface for protecting it. The translucent enclosure as a whole may take many attractive forms and shapes such as conical, cylindrical, pyramidal or different shaped prisms. A pair of spaced embossed transparent layers may be utilized in the various embodiments for increasing the dynamically changing light images as seen by approximately the square of the number of images that would be produced by one layer alone. An interesting display of light having a profusion of color in various arrays and patterns is produced.

25 Claims, 13 Drawing Figures

Fig. 1.
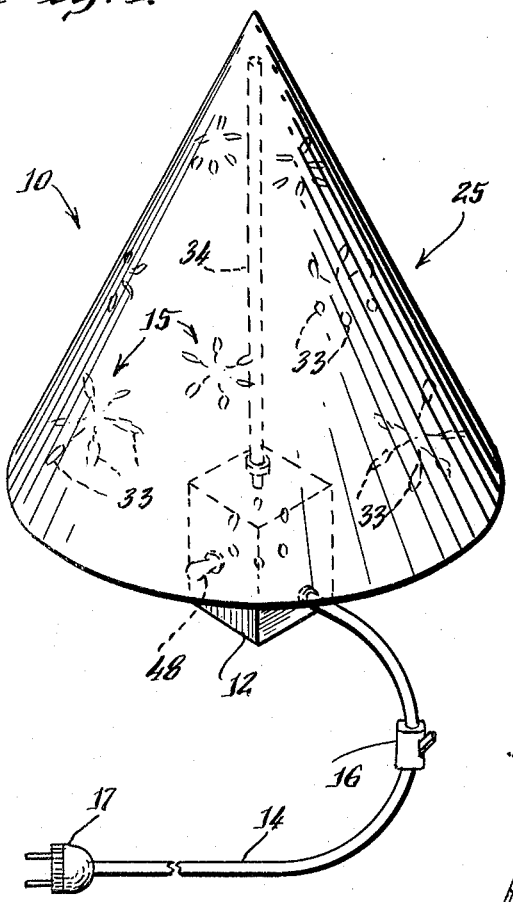
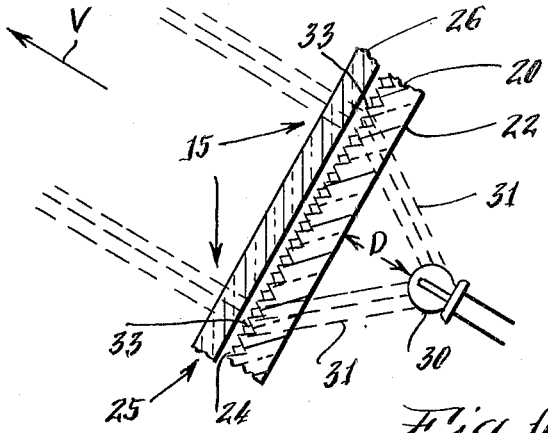
Fig. 10.
Fig. 2.
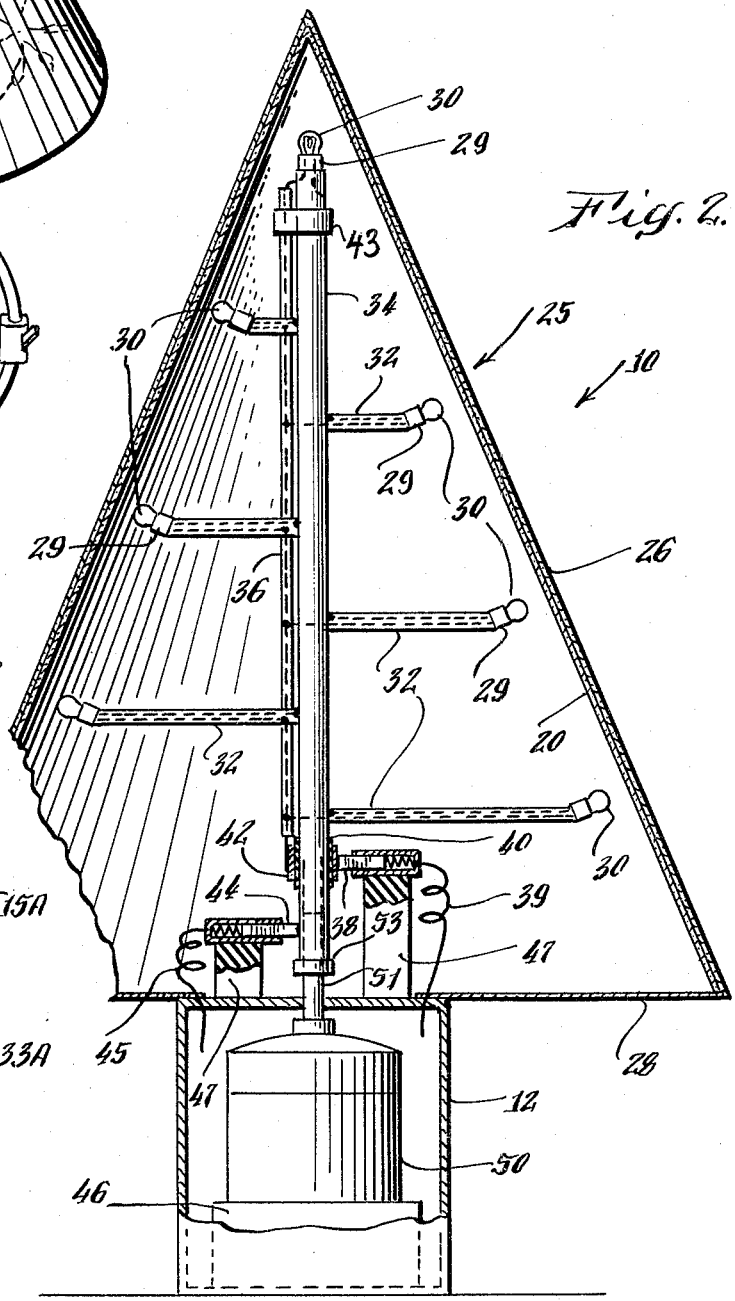
Fig. 11.
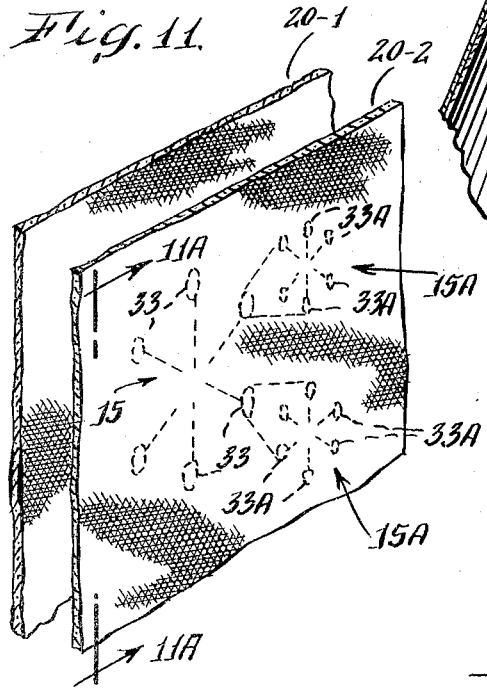

Fig. 3.
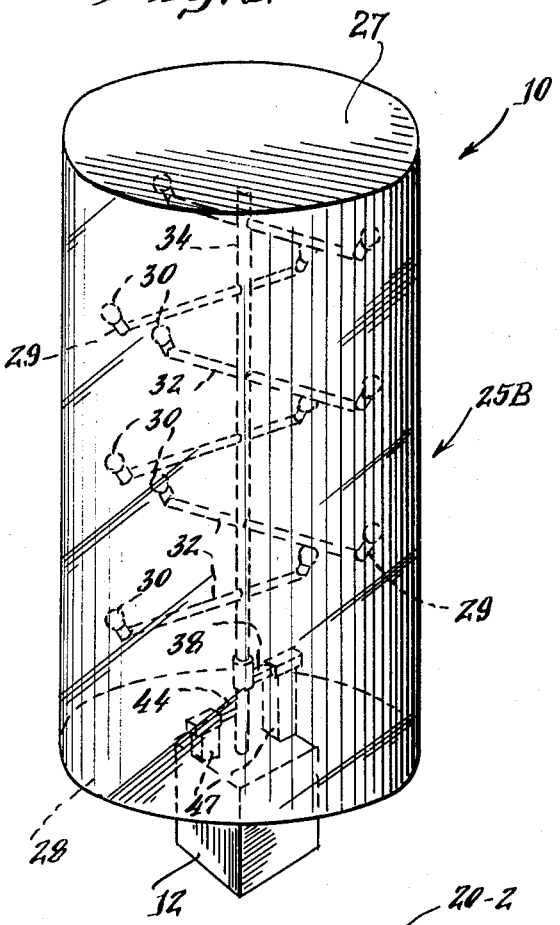
Fig. 4.
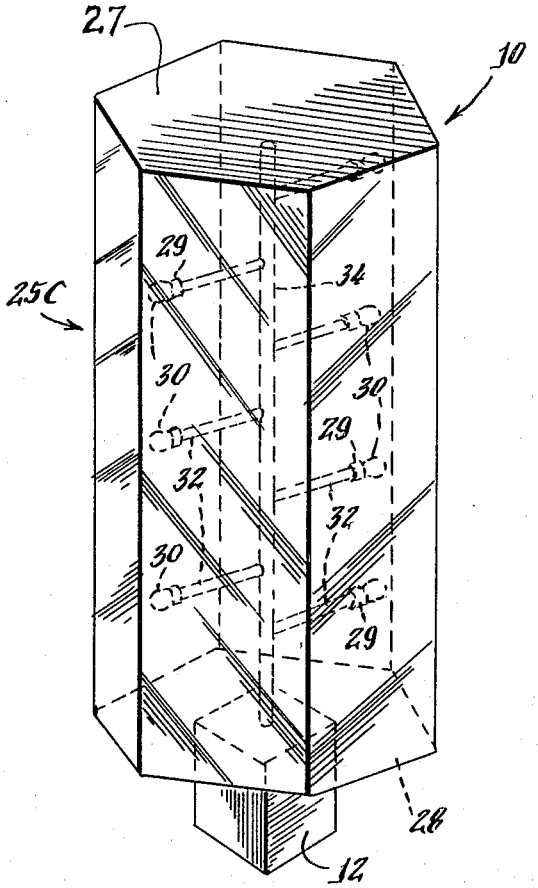
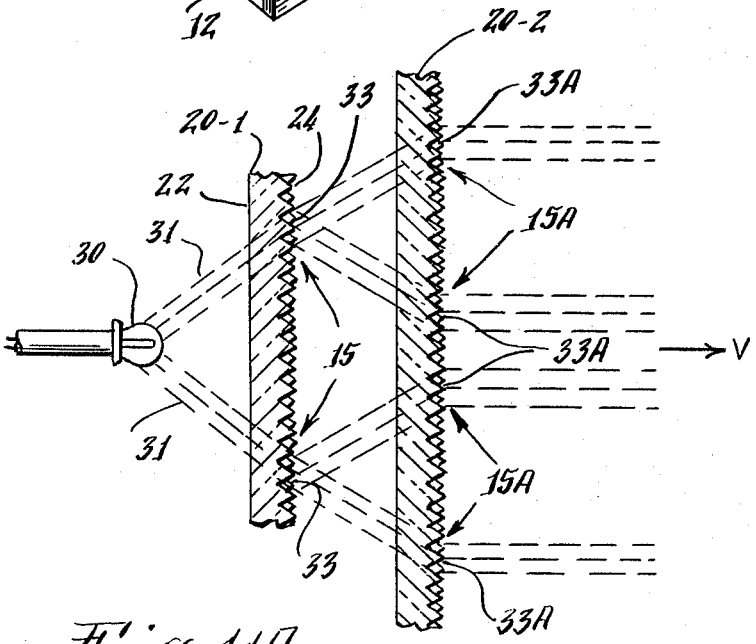
Fig. 11A
Fig. 12.
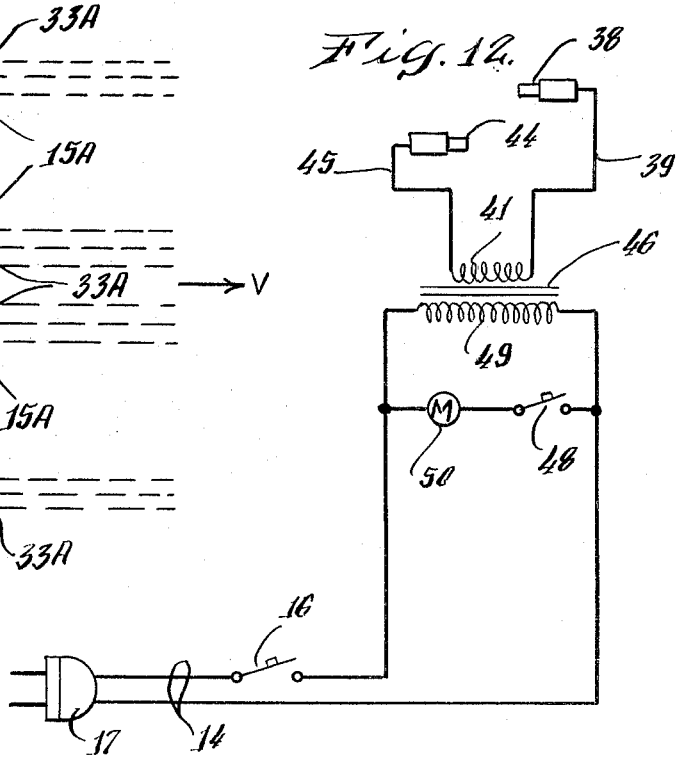

POSITION A

POSITION B

DYNAMIC STAR BURST DISPLAY

BACKGROUND OF THE INVENTION

This invention relates to a decorative illuminated display, and more particularly to a dynamic illuminated display of bursting light patterns in which the light rays from a plurality of light sources are viewed through a translucent enclosure including at least one layer of intrinsically transparent material having an embossed outer surface with the light sources moving effectively toward and away from the enclosure to produce multiple images of the light sources in varying sizes, shapes and colors depending upon the embossed pyramidal prism pattern through which the light rays are transmitted, the spacing between the light sources and the embossed pattern, the position of the viewer, the number of layers of the embossed pattern, and the color of the light sources.

A number of prior art disclosures are directed to illuminated displays particularly to simulated Christmas trees comprising conical shaped members with colored lights either mounted inside or on the conical shaped member. Typical of these are U.S. Pat. No. 2,806,938 which shows a conically shaped tree having stationary circular fluorescent bulbs therein with a revolving conical cover having various predetermined motifs, such as a camel and a star, fixed thereon which are caused by the revolving cover to pass in front of the lights for internally illuminating these fixed motifs on the moving cover.

U.S. Pat. No. 2,297,191 illustrates an illuminated stand for a tree in which a stationary transparent dome-shaped ornamental cover has irregular, jagged and relatively cube-shaped parts thereon to simulate pieces of ice, and this dome is illuminated internally by stationary light bulbs. This stationary transparent dome is described as being molded as a single unitary homogeneous clear glass mass.

Various other displays have been proposed with different colored lights which project through predetermined fixed patterns of perforations in conical members to produce various predetermined illuminated motifs.

SUMMARY OF THE PREFERRED EMBODIMENTS OF THE INVENTION

It is an object of the present invention to provide a new and novel attractive dynamic illuminated display which produces unusual and an exciting pattern of moving light images in a plethora of various sizes, shapes and colors.

A further object of this invention is to provide a new and novel attractive dynamic star burst display which is simple in construction and operation and which may be configured in a variety of shapes and sizes all of which produce exciting, dynamic and exotic illuminated effects.

Still a further object of this invention is to provide a new and novel dynamic star burst display which simulates space age bursting and contracting patterns of light images.

In carrying out this invention in certain illustrative embodiments thereof, a plurality of light sources, which are preferably colored, are mounted in a translucent enclosure for relative movement therebetween for effectively changing the distances between the light sources and the regions of the translucent surface at which the various rays from the respective light sources are being viewed. The translucent enclosure has a layer of intrinsically transparent material with a smooth inner surface facing the light sources and an embossed outer surface having a multiplicity of facets of prismatic or lens-like effect which cause the various rays of the light sources to be seen in distinctive varying light patterns in accordance with the optical and geometrical relationship involved including the refractive and reflective effects of the multiplicity of facets on the embossed outer surface of the translucent enclosure thereby producing the light patterns varying in size and spacing based on the effective distance travelled by the various light rays from the light sources to the embossed layer of transparent material and the position of the viewer. A protective outer transparent or translucent layer is shown as provided to protect the embossed surface. The translucent enclosure may have a plurality of spaced embossed layers for increasing the dynamically changing light images as seen which provides the effect of approximately squaring the number of viewed images from each of the light sources as compared with using a single layer.

The translucent enclosures in their overall configurations may be provided in a variety of shapes and sizes such as cones, pyramids, cylinders or variously shaped prisms.

In a preferred form the plurality of lights are mounted on arms extending from a rotating conductive column, and slip rings are provided on this column to conduct electricity to the lights as they are revolved.

BRIEF DESCRIPTION OF THE DRAWINGS

These and other aspects, features, advantages and further objects will be best understood from a consideration of the following description taken in connection with the accompanying drawings, in which:

FIG. 1 is a perspective view of an illustrative embodiment of this invention in which the translucent enclosure has an overall conical configuration.

FIG. 2 is an enlarged cross-sectional view with parts broken away of the embodiment of FIG. 1.

FIG. 3 is a perspective view of another embodiment of the present invention illustrating a cylindrical configuration.

FIG. 4 is a perspective view of another embodiment of the present invention illustrating a hexagonal prism configuration.

FIG. 10 is an enlarged cross-sectional view of the embossed intrinsically transparent layer, which may have a protective outside transparent or translucent layer, illustrating the projection by the embossed transparent layer of the light source into a multiple image pattern.

FIG. 11 is a perspective view illustrating the use of two spaced layers of the embossed intrinsically transparent material to substantially increase the dynamic complexity and the number of projected light images of the various light sources moving relative to these layers of embossed material.

FIG. 11A is a cross-sectional view taken along the plane 11A—11A of FIG. 11.

FIG. 12 is a schematic electrical diagram illustrating one circuit arrangement which may be employed in practicing the present invention.

DESCRIPTION OF THE PREFERRED EMBODIMENTS

Figure 5:
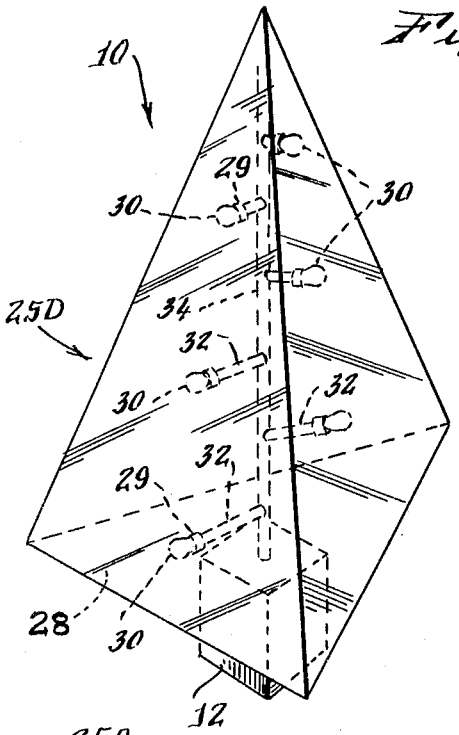
FIG. 5 is a perspective view of another embodiment of the present invention illustrating a pyramidal or tetrahedral configuration.

In the following description like elements will be designated with the same reference numbers in the various figures of the drawings.

Referring now to FIGS. 1 and 2 a display, generally designated with the reference numeral 10, has an overall conical configuration, being mounted on a generally cubical base box 12 having a motor switch 48 positioned thereon and an electrical line cord 14 extending therefrom which contains an on-off switch 16 and a plug 17. A plurality of bursting and contracting patterns 15 of light images 33 are illustrated on the display 10 to indicate that an attractive patterned illuminated display is provided by the apparatus 10, but it will be appreciated as this description unfolds that the dynamic characteristics of this attractive display defy illustration of the exact nature thereof in the drawings.

As will be seen in FIG. 2, the display 10 comprises a translucent enclosure 25 mounted on a support means in the form of a rigid plastic disc 28 which is mounted on the base box 12. A plurality of light sources 30, for example, miniature low-voltage incandescent electric light bulbs, are supported by arms 32 attached to a tubular mast or column 34. The light sources 30 are preferably of various colors.

The base 12 contains a step-down transformer 46 and a motor 50. The motor 50 may be in the form of a small clock motor with suitable speed-reduction gearing to rotate a vertical shaft 51. The lower end of the tubular mast 34 telescopes down over the motor shaft 51 in a firm friction grip thereon and is accordingly rotated thereby. This construction also facilitates the assemblage and disassemblage of the display 10.

Electrical power for the light sources 30 is fed through a pair of carbon brushes 38 and 44. An insulating sleeve 40 mounted on the tubular column 34 has a conductive sleeve 42 mounted thereon which is contacted by the brush 38. The brush 38 is connected through a lead 39 to one side of the secondary winding 41 of a step-down transformer 46. An insulated wire 36 is connected to the conductive sleeve 42 and extends up along the column 34 being held by a ring clamp 43. Each of the plurality of light sources 30 has a socket 29 connected to this supply wire 36 through an insulated wire associated with their respective mounting arms 32 and also is connected by an insulated wire to the column 34 which acts as a common return.

If the pair of insulated wires which fed electrical power out to the respective sockets 29 are sufficiently stiff for rigidly supporting the light sources 30, then these pairs of wires may serve as the support arms 32. The inner ends of these wires are soldered to the mast 34 and to the supply wire 36. The brush 44 engages the lower end of the conductive column 34 and is connected through a lead 45 to the other side of the secondary of the step-down transformer 46. The brushes 38 and 44 are spring-biased into contact with the sleeve 42 and mast 34 respectively, being carried in sockets which are mounted on insulating posts 47 which are positioned on the base 12. A collar or shoulder 53 on the shaft 51 is abutted by the bottom of the tubular mast 34.

The aforesaid electrical connections are illustrated in more detail in FIG. 12. The step-down transformer 46 has its primary winding 49 supplied with power from the line cord 14 through the on-off switch 16. The motor 50 is also connected across the line cord 14 and has an on-off switch 48 in series therewith. With this configuration, selective motor actuation is provided. That is, the motor can be shut off for allowing the light sources to stop revolving for temporarily providing a stationary pattern of illuminated images. The motor can be stopped with the light sources in various positions relative to the transparent enclosure 25 for providing various patterns 15 of light images as may be desired by the viewer.

Power for the light sources 30 is provided through the secondary of the step-down transformer 46 through leads 39 and 45 to the brushes 38 and 44, respectively. Power is supplied by the brush 38 to the wire 36, with the common return being through the conductive column 32 and the brush 44. Power is thus provided to the lights when switch 16 is closed regardless of whether the motor 50 is inactivated, or is activated to revolve the lights 30 within the transparent enclosure 25.

As will best been seen in FIG. 10, the translucent envelope or enclosure 25 comprises a layer of intrinsically transparent plastic material 20, which is effectively rendered translucent by the embossing 24 thereon and at times may be referred to as an embossed transparent layer 20, having a smooth inner surface 22 facing the light sources 30 and an embossed outer surface 24 which causes the light sources 30 to be seen in varying light patterns in accordance with the position of the viewer's eyes and the geometric and optical relationship involved. The embossed outer surface 24 of the transparent layer 20 as shown has a myriad of outwardly projecting tiny pyramidal-shaped prisms or lenses. In these embodiments each of these pyramidal-shaped prisms or lenses is a tiny cube-cornered, three-sided pyramid having three triangular facets and an equilateral triangular shaped base. The outwardly projecting prisms or lenses on the embossed transparent layer 20 produce refraction and/or internal reflection of the various light rays 31 being transmitted through this layer 20. Although tiny three-sided, cube-cornered pyramid shaped prisms or lenses are described in these preferred embodiments, other tiny pyramidal-shaped prisms or lenses could be embossed for producing analogous refraction and/or internal reflection effects.

As indicated in FIG. 10 one of the optical and geometric relationships involved in creating the various patterns 15 of images 33 is the effective distance D between each light source 30 and the embossed transparent layer 20. As this distance D increases, the light rays 31 from the source 30 can spread further apart before these rays reach the embossed transparent layer 20, and consequently a larger pattern 15 of light images 33 are seen by a viewer who is looking from a direction as indicated by the arrow V. Conversely, as the effective distance D decreases, the pattern 15 of the light images 33 decreases. Relative motion between the light source 30 and the embossed transparent layer 20 can sequentially increase and decrease the distance D thereby producing a dynamic bursting and contracting pattern 15 of images 33 of each light source 30.

An example of an embossed plastic layer 20 which may be modified so as to be utilized in various embodiments of the present invention is commercially available under the trademark REFLEXITE. The REFLEXITE sheeting is formed of vinyl plastic material having an embossed surface of multiple very small cube-cornered microprism pyramids for producing retro-reflection. In its commercially available form the REFLEXITE sheeting is useless for practicing this invention because it normally has a white opaque back cover sheet near to the cube-cornered prism surface. In normal use the light to be retro-reflected enters through the smooth front surface, is internally reflected from the microprism back surface and exits from the front surface in a direction directly back toward the light source. For practicing this invention it must be modified by omitting its back cover sheet. In other words, this REFLEXITE sheeting must be obtained especially made (in accordance with my suggestion to the manufacturer) without its customary back cover sheet so that it becomes suitable for transmission of light rays passing therethrough from one side to the opposite side.

In order to obtain other refractive and/or internal reflective effects for producing other attractive patterns of images, the tiny valleys between the transparent prisms or lenses on the embossed surface 24 can be filled with transparent plastic material having a different index of refraction from the plastic material in the layer 20.

Figure 8:
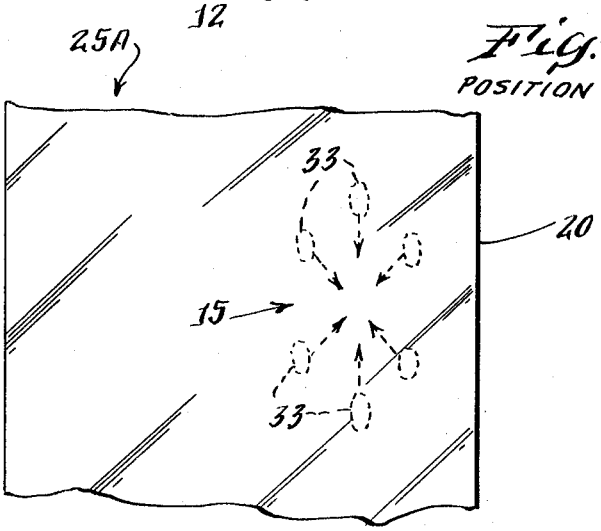
FIG. 8 is a view of a portion of one side of the translucent enclosure of FIG. 7 as seen by a viewer looking from the position 8—8 and illustrating the dynamically varying light pattern projected by the revolving light source when it is momentarily in position A as shown in FIG. 7.
Figure 9:
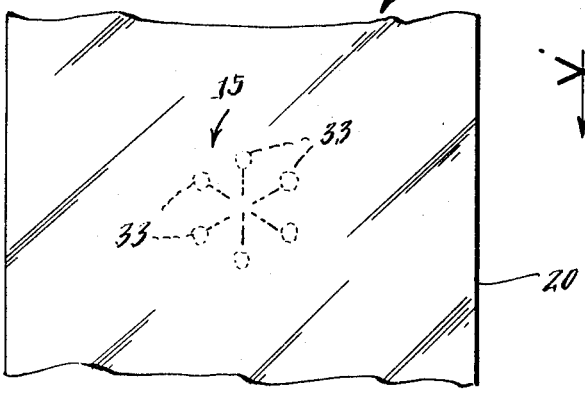
FIG. 9 is a view similar to FIG. 8 illustrating the changed light pattern generated by the same light source which has moved to position B in FIG. 7.

A light source 30 having light rays 31 directed through the smooth inner surface 22 of the embossed layer is projected thereby and forms six images 33 of the source 30. The number of apparent images will depend upon the geometric shapes of the tiny pyramidal prisms or lenses formed on the embossed surface 24. A REFLEXITE sheet used in the transmission mode as described with the embossed surface toward the viewer will produce six images of the light source as illustrated in FIGS. 1, 8 and 9. The outer embossed surface 24 is shown being protected by a semirigid transparent layer 26, for example, a LUCITE or PLEXIGLAS methyl methacrylate sheet, for protecting the myriad of pyramidal facets on the surface 24.

Figure 7:
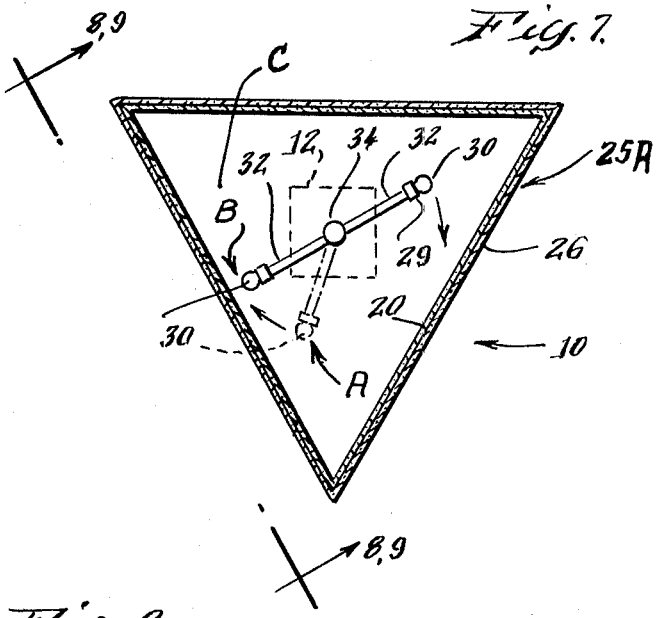
FIG. 7 is a plan cross-sectional view taken along line 7—7 of FIG. 6 and illustrating the changing of the effective distance between one of the revolving light sources and the embossed translucent enclosure.
Figure 6:
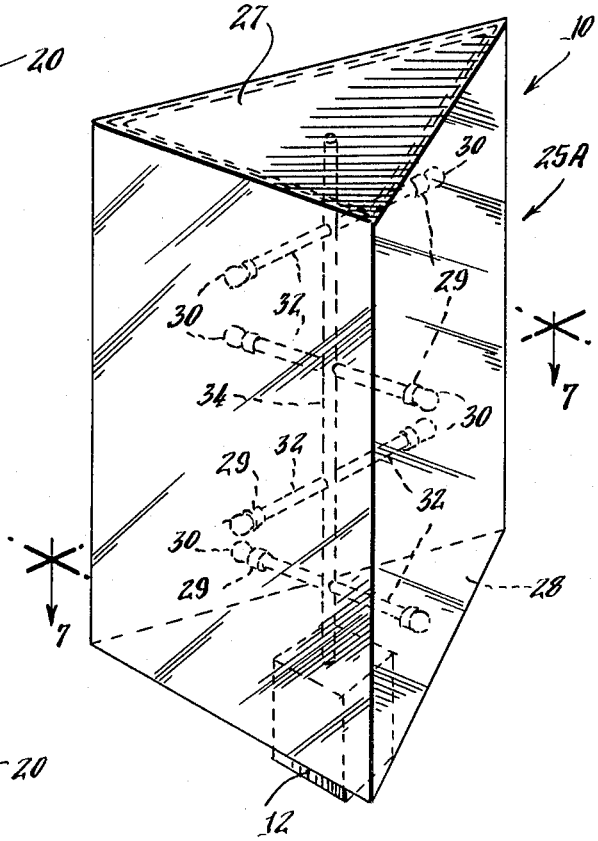
FIG. 6 is a perspective view of another embodiment of the present invention illustrating a triangular prism configuration.

To illustrate one of the dynamic effects which may be achieved in these embodiments of the present invention reference is now made to FIGS. 6 through 9. The dynamic illuminated burst display 10 is illustrated in FIG. 6 with the translucent enclosure or envelope 25A being in the form of a triangular prism. In this configuration as illustrated in FIG. 7, as a light 30 revolves to position A, the pattern 15 of six light images which are visible through the transparent protective layer 26 is illustrated in FIG. 8. The size and shape of this pattern 15 depends on the position of the light source 30 with respect to the embossed surface 24 which is the outer surface of the embossed transparent layer 20. As explained above, the further the light source is from the outer embossed surface 24, the larger and further apart appear the images 33 of the light source 30 in the pattern 15. As will be understood from the arrows in FIG. 8, as the light source 30 moves from position A toward position B in FIG. 7 the pattern of the images 33 appear to be converging.

When the light source 30 has moved to position B as shown in FIG. 7, the pattern 15 of images 33 is illustrated in FIG. 9, indicating a smaller overall pattern in both size and spacing. As the light source continues to move from position B toward position C, a diverging or bursting pattern is produced.

For ease of explanation the pattern for only one moving light source is described in FIGS. 8 and 9. When this effect is multiplied by a number of moving lights, which have been indicated to be preferably multi-colored and again multiplied by the number of sides on surfaces of the prism enclosure 25A the overall effect achieved is truly dynamic and beyond description. For example, in the embodiment shown in FIG. 6 having eight light sources and four surfaces, including the top surface 27, a plethora of bursting and contracting varied colored light patterns are produced by the display 10.

The top surface 27 of the prism enclosure 25A shown in FIG. 6 may also include an embossed layer having a different pattern of embossing or a coating to fill the valleys on the embossed surface for attractively changing the apparent images or effect.

At times the light effects which have been described have been referred to as a star burst or bursting display and this is due to the fact that as the light sources swing away from the region of the embossed transparent layer 20 being seen by the viewer there is an apparent bursting or separation of the light images 33. This effect has been referred to as a star burst, but it should be appreciated that the term is not considered limited to a five or six pointed star but is merely an attempt to describe the visual or optical affect which is produced by the display 10.

As is illustrated in FIGS. 11 and 11A, a plurality of embossed transparent sheets 20-1 and 20-2 may be utilized in spaced relationship to form the translucent envelope or enclosure 25 to provide an even more dazzling display as seen by a viewer positioned in the direction V in FIG. 11A. The effect produced thereby is to convert a source 30 into an initial pattern 15 having multiple images 33, for example, six images, produced by the first embossed transparent layer 20-1 each of which is transformed into a pattern 15A of multiple images 33A, for example, of six images, by the second embossed transparent layer 20-2. Accordingly, the addition of the second embossed layer 20 may square the number of apparent images 33 initially produced from the light source 20 when the embossing on the second transparent layer 20-2 is similar to that on the first layer 20-1. Again, the total overall effect of bursting and contracting colored patterns of light images 33A so multiplied is incapable of description and must be seen to be appreciated. As shown the two embossed transparent layers 20-1 and 20-2 are positioned in spaced parallel relationship. They may be positioned in nonparallel spaced relationship for producing altered light image pattern display effects if desired. Also, the shapes of the tiny prisms or lenses on the second sheet 20-2 may be different from those on the first sheet 20-1 for producing further altered light image patterned display effects.

FIG. 3 illustrates another embodiment of the display apparatus 10 in which the translucent enclosure 25B has a right circular cylindrical configuration with twelve revolving light sources 30 therein. The light sources 30 are at opposite ends of radially aligned arms 32 on the mast 34.

FIG. 4 illustrates another translucent enclosure configuration 25C of the display 10 having a polygon prism configuration in the form of a hexagonal prism. There are seven light sources 30 on arms 32 which are staggered in position on the mast 34.

FIG. 5 illustrates still another embodiment of the display 10 with the translucent enclosure 25D of a pyramid having three sides, being generally tetrahedral in overall shape.

The displays 10 embodying the present invention may employ a wide range of shapes and sizes to achieve a dynamic, exciting and indescribable array of bursting and contracting illuminated patterned image effects. The relative movement or rotation between the sources 30 and the translucent envelope or enclosure 25, 25A, 25B, 25C or 25D is preferably on the order of approximately 3 revolutions per minute which may be obtained using a clock motor with suitable reduction gears. The light sources may be rated at approximately 2½ or 3 volts. The light sources may be connected in parallel as shown in FIG. 2 or they may be connected in series, and the required voltage may be applied thereto through a suitable step-down transformer. Such components are readily available and are relatively inexpensive thereby providing a dynamic bursting illuminated display which is inexpensive and extremely exciting and pleasing to the eye.

When the translucent enclosure has a circular plan view, as in the case of a conical configuration 25 or a circular cylindrical configuration 25B, then all regions of the enclosure are equally far from the axis of rotation, and therefore the light sources 30 must revolve relative to the translucent enclosure in order to produce expanding and contracting patterns 15 of light images. The effective distance D from each light source to the region of the translucent enclosure at which the pattern of its images is seen reaches a minimum when its supporting arm is momentarily extending radially toward the viewer and increases the further that this arm swings away from the region of the enclosure 25 or 25B which is closest to the viewer.

When the translucent enclosure has a non-circular plan view, as in the case of the triangular prism configuration 25A, hexagonal prism configuration 25C or pyramidal configuration 25D (or a rectangular prism configuration which is not shown but which can also be used to advantage), then the light sources 30 can revolve relative to the enclosure or the enclosure can revolve relative to the light sources. When the light sources revolve relative to the enclosure, their effective distance from the region of the enclosure at which the pattern of their images is seen changes as shown in FIGS. 7, 8 and 9. When the enclosure is revolved relative to the light sources, the effective distance from the light sources to the regions being viewed also changes because the corners and edges of the non-circular enclosure are intrinsically further from the axis of revolution and hence are further from the light sources than the central regions of each side.

It is my preference to have the translucent enclosure stationary and to revolve the light sources therein, because this seems to me to produce the most pleasing effects. However, it is also possible in cases of a non-circular enclosure plan to revolve the enclosure as explained above. If desired, both the non-circular plan enclosure and the light sources may be revolved.

The protective layer 26 is not illustrated in FIGS. 11 and 11A, but it may be included if desired. It is to be understood that this protective layer 26 may be omitted from any use of the embodiments if desired. The protective layer 26 may be tinted and is preferred to be transparent, but it may be translucent for producing a pleasing muted effect. As used herein the term "pellucid" as applied to the layer 26 is intended to include the preferred transparent form as well as the translucent form.

Although the material comprising the layer 20, 20-1 or 20-2 is intrinsically transparent, it is effectively rendered translucent by the embossing 24 thereon, because objects within the enclosure 20 cannot be clearly distinguished by a viewer looking at the outside of the enclosure. The intrinsically transparent material comprising the layer 20, 20-1 or 20-2, may be tinted, if desired.

Since other modifications and changes varied to fit particular operating requirements and environments will be apparent to those skilled in the art, the invention is not considered limited to the examples chosen for purposes of illustration and includes all changes and modifications which do not constitute departures from the true spirit and scope of this invention as defined in the following claims.

What is claimed is:

1. A dynamic display of attractive patterns of moving light images comprising:

(a) a plurality of light sources, (b) an enclosure having a viewable translucent layer, (c) mounting means for positioning said plurality of light sources in spaced relation within said enclosure, (d) drive means for providing relative movement between said plurality of light sources and said viewable translucent layer for moving the respective light sources closer to and farther away from said viewable layer, (e) means for supplying electric power to said plurality of light sources for energizing said light sources, (f) said viewable translucent layer being made of intrinsically transparent material having an outer surface containing a myriad of outwardly-projecting tiny pyramidal-shaped prisms positioned adjacent to each other, (g) said pyramidal-shaped prisms being so tiny and so numerous that they cause said layer of intrinsically transparent material to appear translucent as viewed from the outside, (h) said tiny pyramidal-shaped prisms causing each of said light sources to be seen in a pattern of light images as viewed by looking at the outside of said viewable layer, and (i) said light patterns varying in size and spacing as the effective distances between said light sources and said viewable layer increases and decreases due to the relative movement between said light sources and said viewable layer.

2. A dynamic display of pleasing patterns of light images comprising:

(a) a plurality of light sources, (b) an enclosure having a viewable translucent layer, (c) mounting means for positioning said plurality of light sources in spaced relation within said enclosure, (d) means for providing relative movement between said plurality of light sources and said viewable translucent layer for varying the distances between said sources and said layer, (e) means for applying a source of electrical power to said plurality of light sources for energizing said light sources, (f) said viewable translucent layer being a layer of intrinsically transparent material having an outer surface which includes a great multitude of tiny, multifaceted transparent protrusions positioned adjacent to each other for causing said light sources to be viewed from the outside of said enclosure in patterns of light images which vary in apparent size and spacing with changes in the effective distances between each of said light sources and the respective regions of said translucent layer at which said light images are momentarily being viewed as said relative movement between light sources and said viewable layer is occurring.

3. A dynamic display of patterns of light images as claimed in claim 2, in which:

said viewable layer of intrinsically transparent material has an outer surface which includes a multitude of tiny, multifaceted transparent pyramids protruding outwardly and being so numerous and so small as to cause said intrinsically transparent layer to appear translucent as viewed from the outside.

4. The dynamic display set forth in claim 2 or 3 having a plurality of said layers spaced one from another with one of said layers being outside of the other, said outside layer having a smooth inner surface facing toward the other layer and having an outer surface including a great multitude of tiny, multifaceted transparent pyramidal protrusions.

5. The dynamic display set forth in claim 2 or 3 having a pellucid outer protective layer.

6. The dynamic display as claimed in claim 2 or 3, in which:

said means for providing relative movement between said plurality of light sources and said viewable layer includes drive mechanism for revolving said mounting means within said enclosure.

7. The dynamic display set forth in claim 2 or 3, wherein said means for providing relative movement between said plurality of light sources and said viewable layer comprises:

(a) a motor driving a rotatable shaft, and (b) a support column having said light sources mounted thereon, said column being connected to said shaft for revolving said light sources within said enclosure.

8. The dynamic display as claimed in claim 7, in which:

said enclosure has an overall geometric configuration with a vertical axis, said support column extends upright along said axis, and a plurality of arms extend from said column with said light sources being mounted at the outer ends of the respective arms.

9. The dynamic illuminated bursting display set forth in claim 7 wherein said means for applying electrical power to said plurality of light sources comprises:

(a) a pair of electrical brushes, (b) a pair of electrically conductive regions encircling said column and being electrically insulated from each other with said brushes engaging the respective conductive regions in sliding relationship, (c) insulated wiring mounted on said column and connecting said light sources in circuit with said conductive regions, and (d) a source of electrical power coupled to said brushes, whereby power is applied to said light sources as said column rotates.

10. The dynamic display set forth in claim 2 or 3 in which said enclosure has such a viewable layer in a conical configuration.

11. The dynamic display set forth in claim 2 or 3 in which said enclosure has a triangular configuration as seen in plan view and such viewable layers are included in three sides of said enclosure.

12. The dynamic display set forth in claim 2 or 3 in which said enclosure has a prism configuration and such viewable layers are included in the respective sides of said prism.

13. The dynamic display set forth in claim 2 or 3 in which said enclosure has such a viewable layer in a cylindrical configuration.

14. The dynamic display set forth in claim 2 or 3 in which said light sources have different colors.

15. The dynamic display as claimed in claim 3, in which:

each of said tiny, multi-faceted transparent pyramidal protrusions is a very small pyramid.

16. The dynamic display as claimed in claim 15 in which:

each of said very small pyramids has three triangular faces.

17. A dynamic display as claimed in claim 15 or 16, in which:

the valleys between said very small pyramids are filled with a transparent material having a different index of refraction from the material of which said layer is made.

18. A dynamic display of attractive patterns of light images comprising:

(a) a plurality of light sources, (b) a translucent enclosure, (c) mounting means for positioning said plurality of light sources in spaced relationship within said enclosure, (d) drive means for providing relative movement between said plurality of light sources and said translucent enclosure, (e) means for supplying electrical power to said light sources for energizing them, (f) said translucent enclosure including a transparent layer of material having an outer surface which includes a myriad of very tiny transparent protrusions positioned adjacent to each other and each having a plurality of triangular shaped faces for producing a pattern of light images of each of said light sources, and (g) the patterns of said light images increasing in size as the effective distance increases between the respective light sources and the respective regions of said translucent enclosure at which said light images are being momentarily viewed, and vice versa, as said relative movement occurs between said light sources and said enclosure.

19. The dynamic display of attractive patterns of light images as claimed in claim 18, in which:

said drive means revolves said mounting means within said translucent enclosure for producing said relative movement.

20. An attractive display of light comprising:

(a) at least one light source, (b) a layer of transparent material positioned in front of said light source and being spaced from said light source, (c) the surface of said layer facing away from said light source being the front surface, (d) said front surface being viewable by an observer positioned ahead of said front surface, (e) said front surface having thereon a myriad of tiny cube-covered, three-sided pyramids each having three triangular facets and an equilateral triangular-shaped base, the bases of said pyramids being located adjacent to each other in said front surface, (f) said pyramids being so numerous and so tiny as to cause said layer to appear translucent as seen by an observer positioned ahead of said front surface, (g) means for changing the relative distance between said light source and said layer, and (h) said layer causing said light source to appear to said observer as a star-like pattern of six light images whose size increases as said light source relatively moves farther away from said layer, and vice versa.

21. An attractive display of light as claimed in claim 20, in which:

the valleys between said myriad of tiny pyramids are filled with a transparent material having a different index of refraction from the transparent material of which said pyramids are made.

22. An attractive display of light comprising:

(a) at least one light source, (b) a layer of light-transmitting material positioned in front of said light source and being spaced from said light source, (c) the surface of said layer facing away from said light source being the front surface and said front surface being viewable by an observer positioned ahead of said front surface, (d) said front surface having thereon a myriad of tiny outwardly projecting adjacent transparent pyramids each having multiple triangular facets, (e) said pyramids being so numerous and so tiny as to cause said layer to appear translucent as seen by an observer positioned ahead of said front surface, and (f) means for changing the relative distance between said light source and said layer for causing said light source to appear to an observer who is looking at the front surface of said layer as a pattern of multiple light images with the size of said pattern increasing as the light source moves relatively farther away from said layer, and vice versa.

23. An attractive display of light comprising:

(a) at least one light source, (b) a layer of transparent material positioned in front of said light source and being spaced from said light source, (c) said layer of transparent material being viewable by an observer positioned in front of said layer, (d) said layer having a myriad of tiny adjacent pyramids formed in the transparent material of said layer, said pyramids each having a plurality of triangular facets, (e) said pyramids being so numerous and so tiny as to cause said layer to appear translucent as seen by an observer in front of said layer, and (f) means for changing the relative distance between said light source and said layer for causing said light source to appear to the observer who is looking at said layer as a changing size pattern of multiple light images, with the size of the pattern increasing as the light source moves relatively farther away from said layer and decreasing as the light source moves relatively closer to said layer.

24. An attractive display of light as claimed in claim 22, in which:

the surface of said layer facing toward said light source is smooth.

25. An attractive display of light as claimed in claim 22 or 24, in which:

the valleys between said myriad of tiny pyramids contain a transparent material having a different index of refraction from the transparent material of which said tiny pyramids are made.

* * * * *